US008989429B2

(12) United States Patent
Flavignard et al.

(10) Patent No.: US 8,989,429 B2
(45) Date of Patent: Mar. 24, 2015

(54) ELECTRODYNAMIC TRANSDUCER HAVING A DOME AND A BUOYANT HANGING PART

(75) Inventors: Yoann Flavignard, Chartrettes (FR); Philippe Lesage, Chartrettes (FR)

(73) Assignee: PHL Audio, Chartrettes (FR)

( * ) Notice: Subject to any disclaimer, the term of this patent is extended or adjusted under 35 U.S.C. 154(b) by 186 days.

(21) Appl. No.: 13/522,199

(22) PCT Filed: Jan. 14, 2011

(86) PCT No.: PCT/FR2011/000025

§ 371 (c)(1),
(2), (4) Date: Dec. 10, 2012

(87) PCT Pub. No.: WO2011/086302

PCT Pub. Date: Jul. 21, 2011

(65) Prior Publication Data

US 2013/0114846 A1 May 9, 2013

(30) Foreign Application Priority Data

Jan. 15, 2010 (FR) ..... 10 00156

(51) Int. Cl.

| | |
|---|---|
| ***H04R 9/04*** | (2006.01) |
| *H04R 7/12* | (2006.01) |
| *H04R 7/16* | (2006.01) |

(52) U.S. Cl.

CPC ..... *H04R 9/046* (2013.01); *H04R 9/043* (2013.01); *H04R 7/127* (2013.01); *H04R 7/16* (2013.01); *H04R 2307/025* (2013.01); *H04R 2307/027* (2013.01); *H04R 2307/029* (2013.01)

USPC ..... 381/398; 381/400; 381/404; 381/405; 381/430; 181/171

(58) Field of Classification Search

CPC ..... H04R 7/16; H04R 9/043; H04R 2231/003
USPC ..... 381/398, 404, 430, 400, 405; 181/166, 181/171, 172

See application file for complete search history.

(56) References Cited

U.S. PATENT DOCUMENTS

| | | | |
|---|---|---|---|
| 1,631,646 | A | 6/1927 | Rice |
| 1,707,545 | A | 4/1929 | Wente |

(Continued)

FOREIGN PATENT DOCUMENTS

| | | | |
|---|---|---|---|
| DE | 102 07 561 | C1 | 7/2003 |
| DE | 102 11 086 | A1 | 10/2003 |

(Continued)

OTHER PUBLICATIONS

International Search Report of PCT/FR2011/000023, dated Apr. 20, 2011.

(Continued)

*Primary Examiner* — Curtis Kuntz
*Assistant Examiner* — Joshua A Kaufman
(74) *Attorney, Agent, or Firm* — Sughrue Mion, PLLC

(57) ABSTRACT

Electro-dynamic transducer including a main magnetic circuit defining an air gap, a moving part comprising a dome shaped diaphragm and a movable coil fixed thereto and diving into the air gap; a support to which the moving part is suspended; and a suspension linking the moving part and the support; wherein the suspension is floating with respect of the support, allowing a radial degree of freedom.

19 Claims, 5 Drawing Sheets

(56) References Cited

U.S. PATENT DOCUMENTS

| | | | | | |
|---|---|---|---|---|---|
| 1,707,570 | A | | 4/1929 | Rice | |
| 1,766,473 | A | | 6/1930 | Wente | |
| 1,907,723 | A | | 5/1933 | Bostwick | |
| 1,930,915 | A | | 10/1933 | Wente | |
| 2,037,187 | A | | 4/1936 | Wente | |
| 2,269,284 | A | | 1/1942 | Olson | |
| 2,442,791 | A | | 6/1948 | Wente | |
| 2,490,466 | A | | 12/1949 | Olson et al. | |
| 2,840,177 | A | * | 6/1958 | Schoengold | 181/172 |
| 3,328,537 | A | | 6/1967 | Hecht | |
| 3,867,586 | A | * | 2/1975 | Maekawa et al. | 381/340 |
| 3,991,286 | A | * | 11/1976 | Henricksen | 381/189 |
| 4,164,631 | A | | 8/1979 | Garner et al. | |
| 4,256,930 | A | | 3/1981 | Garner et al. | |
| 4,283,606 | A | | 8/1981 | Buck | |
| 4,433,214 | A | * | 2/1984 | Jasinski | 381/398 |
| 4,531,608 | A | * | 7/1985 | Heinz | 181/172 |
| 4,532,383 | A | | 7/1985 | Willy | |
| 4,752,963 | A | * | 6/1988 | Yamazaki et al. | 381/430 |
| 4,799,266 | A | * | 1/1989 | Sakamoto et al. | 381/398 |
| 4,933,975 | A | | 6/1990 | Button | |
| 4,965,839 | A | | 10/1990 | Elieli | |
| 5,018,206 | A | | 5/1991 | Suzuki | |
| 5,042,072 | A | | 8/1991 | Button | |
| 5,157,731 | A | * | 10/1992 | Mitobe | 381/420 |
| 5,181,253 | A | | 1/1993 | Jordan | |
| 5,255,328 | A | * | 10/1993 | Akiniwa et al. | 381/398 |
| 5,471,437 | A | | 11/1995 | Schutter et al. | |
| 5,475,765 | A | | 12/1995 | Lyth | |
| 5,602,930 | A | | 2/1997 | Walton | |
| 5,875,252 | A | * | 2/1999 | Lesage | 381/340 |
| 6,208,743 | B1 | | 3/2001 | Marten et al. | |
| 6,219,432 | B1 | * | 4/2001 | Fryer et al. | 381/398 |
| 6,222,931 | B1 | * | 4/2001 | Cesati | 381/427 |
| 6,259,800 | B1 | * | 7/2001 | Tagami | 381/412 |
| 6,269,168 | B1 | | 7/2001 | Tagami | |
| 6,647,122 | B1 | | 11/2003 | Jones | |
| 6,792,125 | B1 | | 9/2004 | David et al. | |
| 6,922,477 | B1 | | 7/2005 | Ikeyama | |
| 6,963,650 | B2 | | 11/2005 | Combest | |
| 7,035,424 | B1 | | 4/2006 | Brandt | |
| 7,057,314 | B2 | | 6/2006 | Moro | |
| 7,245,739 | B2 | * | 7/2007 | Suzuki | 381/430 |
| 8,094,863 | B2 | * | 1/2012 | Ding | 381/398 |
| 2003/0051940 | A1 | | 3/2003 | Anthony et al. | |
| 2004/0086143 | A1 | | 5/2004 | Espiritu | |
| 2004/0202342 | A1 | | 10/2004 | Anthony et al. | |
| 2005/0069166 | A1 | | 3/2005 | Peng | |
| 2005/0254682 | A1 | * | 11/2005 | Maekawa et al. | 381/404 |
| 2006/0133637 | A1 | | 6/2006 | Proni | |
| 2006/0285705 | A1 | | 12/2006 | Kong | |
| 2007/0009133 | A1 | | 1/2007 | Gerkinsmeyer | |
| 2007/0145637 | A1 | * | 6/2007 | Sato et al. | 264/259 |
| 2007/0201718 | A1 | | 8/2007 | Shimoe et al. | |
| 2008/0166010 | A1 | | 7/2008 | Stiles et al. | |
| 2009/0003632 | A1 | * | 1/2009 | Lin et al. | 381/182 |
| 2011/0044490 | A1 | * | 2/2011 | Makino | 381/398 |
| 2013/0064414 | A1 | * | 3/2013 | Flavignard et al. | 381/412 |
| 2013/0121522 | A1 | * | 5/2013 | Flavignard et al. | 381/340 |

FOREIGN PATENT DOCUMENTS

| | | | | | |
|---|---|---|---|---|---|
| EP | 0 122 990 | A1 | | 10/1984 | |
| EP | 0 341 926 | A1 | | 11/1989 | |
| EP | 0 551 845 | A1 | | 7/1993 | |
| EP | 0 622 971 | A1 | | 11/1994 | |
| EP | 0 624 049 | A2 | | 11/1994 | |
| EP | 0 749 265 | A1 | | 12/1996 | |
| EP | 1 515 584 | A1 | | 3/2005 | |
| EP | 1 755 357 | A2 | | 2/2007 | |
| EP | 1 976 331 | A1 | | 10/2008 | |
| FR | 2 565 058 | A1 | | 11/1985 | |
| FR | 2 667 212 | A1 | | 3/1992 | |
| FR | 2 892 887 | A1 | | 5/2007 | |
| GB | 652378 | A | | 4/1951 | |
| GB | 701395 | A | | 12/1953 | |
| GB | 2 250 658 | A | | 6/1992 | |
| GB | 2 404 520 | A | | 2/2005 | |
| JP | 55-010217 | A | | 1/1980 | |
| JP | 60-253399 | A | | 12/1985 | |
| WO | 95/28065 | A1 | | 10/1995 | |
| WO | WO 96/13960 | | * | 5/1996 | H04R 9/06 |
| WO | 99/30533 | A1 | | 6/1999 | |
| WO | 02/054826 | A1 | | 7/2002 | |
| WO | 2007/122386 | A1 | | 11/2007 | |
| WO | 2007/122390 | A1 | | 11/2007 | |
| WO | 2008/008034 | A1 | | 1/2008 | |

OTHER PUBLICATIONS

French Preliminary Search Report for FR 1000154, dated Aug. 5, 2010.

French Preliminary Search Report for FR 1000155, dated Aug. 5, 2010.

French Preliminary Search Report for FR 1000156, dated Aug. 5, 2010.

French Preliminary Search Report for FR 1000157, dated Aug. 6, 2010.

International Search Report of PCT/FR2011/000024, dated Apr. 20, 2011.

International Search Report of PCT/FR2011/000025, dated Apr. 28, 2012.

* cited by examiner

ELECTRODYNAMIC TRANSDUCER HAVING A DOME AND A BUOYANT HANGING PART

CROSS REFERENCE TO RELATED APPLICATIONS

This application is a National Stage of International Application No. PCT/FR2011/000025 filed Jan. 14, 2011, claiming priority based on French Patent Application No. 1000156 filed Jan. 15, 2010, the contents of all of which are incorporated herein by reference in their entirety.

BACKGROUND

1. Field of the Invention

The invention generally relates to the field of sound reproduction by means of loudspeakers, also named electro-dynamic or electro-acoustic transducers, which convert an electrical energy generally delivered by an amplifier into acoustical energy.

2. Description of the Related Art

Acoustical energy is radiated through a diaphragm the displacements of which induce variations of pressure of the ambient air, which propagate in space under the form of an acoustic wave.

In the Rice-Kellog type electro-dynamic transducer, which is the most common, the diaphragm is driven by a movable coil including a solenoid in which passes an electric current (from the amplifier) and which dives into an air gap filled with a magnetic field produced by a permanent magnet. Interaction between the electric current and the magnetic field induces a force known as the Laplace force driving the movable coil, which in turn drives the diaphragm, the vibrations of which produce an acoustic radiation.

Numerous designs were imagined for diaphragms; most common shapes are a cone (the generatrix of which may be straight or curved) and a dome, or a combination thereof.

In the case of the cone, the movable coil is generally fixed onto the edge of an opening formed in the center of the diaphragm. The size and mass of the moving part are somewhat important, reason for which such architecture is especially adapted to the manufacture of transducers designed for the reproduction of low range and mid range frequencies, requiring diaphragm vibrations of low frequency and great amplitude.

In the case of the dome, the movable coil is generally fixed to a peripheral edge of the diaphragm. The size and mass of the moving part may be minimize, reason for which such architecture is especially adapted to the manufacture of transducer designed to reproduce of high range, due to diaphragm vibrations of high frequency and low amplitude.

Whichever its shape, the diaphragm is generally fixed to a chassis of the transducer trough a peripheral suspension which, in addition to its primary function of holding the diaphragm, has three general functions:

- return effect to the diaphragm toward a rest position,
- producing a secondary acoustic radiation which adds to the radiation of the diaphragm.
- centering and axial guiding of the moving part (including the diaphragm and the movable coil) with respect of the air gap, In cone diaphragm transducers, due to great displacements, the suspension is generally not sufficient to guide the diaphragm with respect of the air gap. This is which complementary centering devices are generally provided, like of the spider type (Cf. French patent application FR 2 667 212 in the name of the applicant).

In the case of dome shaped diaphragms, the displacements of which are far smaller, a sole peripheral suspension is generally provided to ensure all three functions discussed hereinbefore. Such a topology has been known for a long time, Cf. U.S. Pat. No. 2,242,791 (Edward C. Wente/Bell Laboratories) of June 1948. A more recent example is exposed in US patent application No. US 2008/0166010 (Stiles et al).

It is known that axial guiding and centering of the diaphragm with respect of the air gap are an essential function of the suspension. Indeed, it is necessary to avoid (or at least minimize) the transversal movements (swinging, pitch) of the diaphragm, considered as defects which generate distortions within the emitted sound signal. In particular, the coil may rub on the walls of the air gap. Such a rubbing induces strong distortions and parasite noises which prevent use of the transducer.

This is why the centering of the moving part with respect of the air gap is a tricky assembly operation, which requires taking into account all manufacturing clearances (in particular of the magnetic circuit) and also requires a very precise fixation of the suspension on the transducer chassis. Such an operation is difficult to automate. Despite all precautions, rubbing of the moving coil on a side wall of the air gap may arise and it is usual, in order to minimize such occurrence, to provide between the moving coil and the air gap important internal and external operational clearances, of several tenths of millimeter.

However, enlarging the air gap has harmful consequences:

- it decreases, in a same magnetic circuit, the density of magnetic flow within the air gap, which decreases in proportion the driving force provided to the moving coil and thereby decreases the efficiency of the transducer,
- it decreases the capability of dissipating heat produced by Joule effect within the coil, due to the thickness of air layers which surround the coil and act as thermal insulators.

Part of the efforts made by the loudspeaker manufacturers is directed toward the research of the best compromise between centering clearances of the moving part with respect of the air gap (and hence suspension dimensioning and/or fixing clearances), and the acoustic performances of the transducer. As already stated, increasing the clearances decreases the performances. Of course, in an industrial manufacturing environment, the choice is generally directed to an increase of clearances, and a decrease of acoustical performances.

In order to address this problem, the applicant has made the opposite choice, in order not to scarify performances and to search for pertinent and rational solutions in the transducer architecture.

The invention therefore aims at proposing a solution to the problems disclosed hereinbefore, in particular for high range transducers, and at providing improvements to dome diaphragms in order to facilitate the assembly thereof without sacrificing the acoustical performances.

SUMMARY

The invention therefore provides, in a first aspect, an electro-dynamic transducer including:

- a main magnetic circuit defining an air gap,
- a moving part comprising a dome shaped diaphragm and a movable coil fixed thereto and diving into the air gap;
- a support to which the moving part is suspended;
- a suspension linking the moving part and the support;

wherein the suspension is floating with respect of the support, allowing a radial degree of freedom.

Accordingly, the suspension no longer provides a centering function. This function is provided directly at the level at the air gap, when the moving coil is powered by a modulation electrical current. Such architecture allows for a decrease of the operation clearance around the moving coil, thereby enhancing the sensitivity of the transducer.

The decrease of clearances reduces the thickness of air layers around the solenoid, and hence the thermal resistance between the solenoid and the magnetic circuit. This enhances thermal dissipation and, consequently, allows for an increase of the permissible power of the transducer.

In one embodiment, the support comprises a peripheral groove and the suspension is under the form of a ring an inner edge of which is cast into the grove. A clearance of more than 0.1 mm is preferably provided between the suspension and a bottom of the groove.

The support may comprise a plate in which the groove is formed, and a rod fixed to the plate and through which the support is fixed to the magnetic circuit.

In one embodiment, the groove is limited by two facing flanges and the suspension is slightly constrained between the flanges.

The suspension is preferably made of a polymer reticulated foam, such as melamine foam.

In one embodiment, at least one wall of the air gap is coated with a low friction material, such as PTFE.

In addition, the air gap and the moving coil are preferably such dimensioned that the occupation rate of the moving coil within the air gap is equal or greater than 50%.

In one embodiment, the magnetic circuit comprises a pole piece around which the moving coil is positioned, and a clearance of less than a tenth of a millimeter is provided between them.

A lubricant (preferably pasty) may be provided between the suspension and the support.

The invention provides, in a second aspect, a coaxial two-way or more loudspeaker system comprising a low range electro-dynamic transducer for the reproduction of low range and/or mid range frequencies, and an electro-dynamic transducer as disclosed previously, for the reproduction of high range frequencies.

In this system the high range transducer may be mounted in a coaxial and frontal position with respect of the low range transducer.

In a third aspect, the invention provides a loudspeaker enclosure including a transducer or a coaxial loudspeaker system as disclosed hereinbefore.

BRIEF DESCRIPTION OF THE DRAWINGS

The above and other objects and advantages of the invention will become apparent from the detailed description of preferred embodiments, considered in conjunction with the accompanying drawings in which.

DETAILED DESCRIPTION

Figure 1:
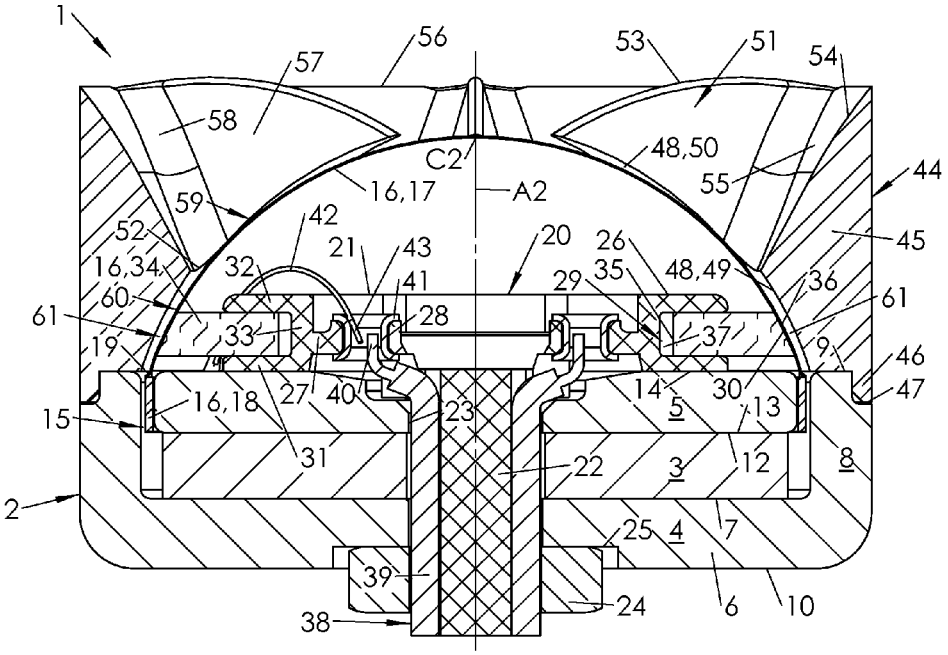
FIG. 1 is a sectional view showing a high range dome transducer in one embodiment of the invention.
Figure 2:
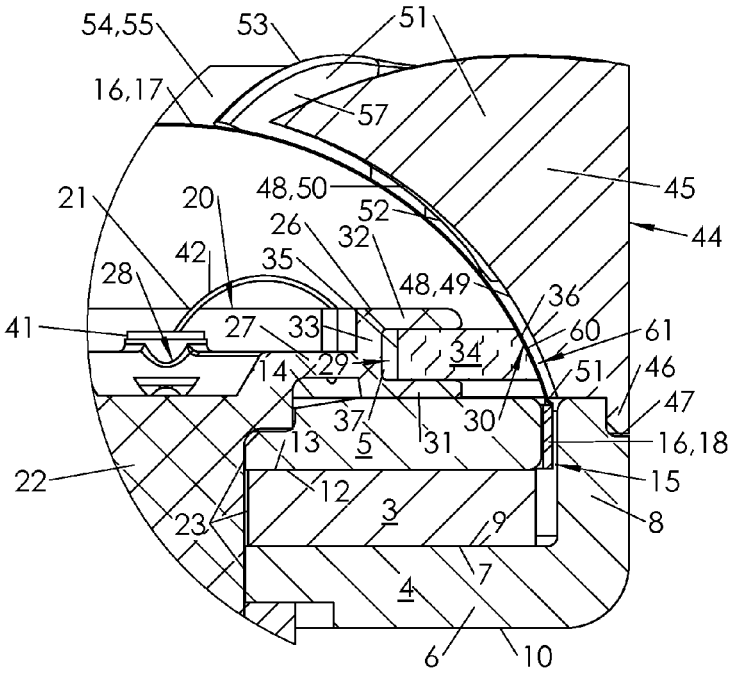
FIG. 2 is a view of a detail of FIG. 1.
Figure 3:
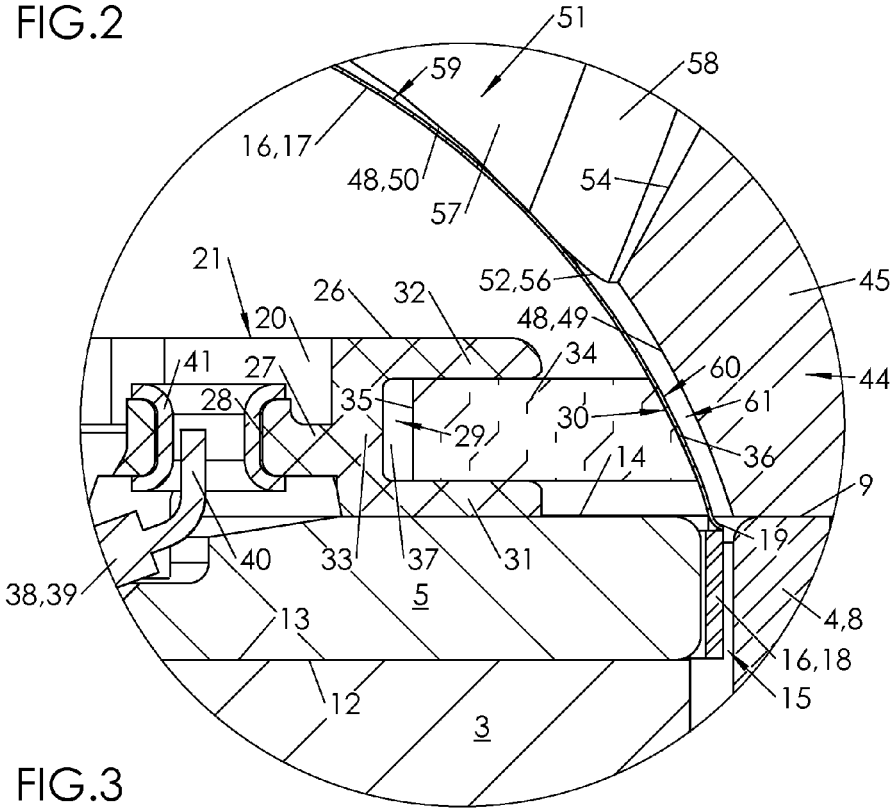
FIG. 3 is a sectional view, with enlarged scale, of a detail of the transducer of FIG. 1, in a different point of view.

In FIG. 1-5, more precisely in FIG. 1 and FIG. 3 is illustrated an electro-dynamic transducer 1 adapted for reproducing high range frequencies, i.e. of about 1 kHz to 20 kHz.

The transducer 1 comprises a magnetic circuit 2 which includes a permanent central annular magnet 3, sandwiched between two pole pieces which form field plates, i.e. a back pole piece 4 and a front pole piece 5, glued on opposite face of the magnet 3.

The magnet 3 and the pole pieces 3, 4 have rotational symmetry around a common axis A2 forming the general axis of the transducer 1.

The magnet 3 is preferably made of a rare earth element neodymium iron boron alloy, which has the advantages of offering a high density of energy (up to twelve times higher than a permanent magnet of barium ferrite).

As depicted on FIG. 1, the back pole piece 4, called yoke, is of one piece and made of soft steel. It has a form of a cup with a U-shape transversal section, and has a bottom 6 fixed to a back face 7 of the magnet 3, and a peripheral side wall 8 extending axially from the bottom 6. The side wall 8 ends, at a front end opposite to the bottom 6, by an annular front face 9. The bottom 6 has a back face 10.

The front pole piece 5, called core, is also made of soft steel. It is of annular form and has a back face 12, by which it is fixed to a front face 13 of the magnet 3, and an opposite front face 14 which extends in the same plane as the front face 9 of the side wall 8 of the yoke 4.

As depicted on FIG. 1, the magnetic circuit 2 is extra-thin, i.e. its thickness is small with respect of its overall diameter. In addition, the magnetic circuit 2 extends up to the outer diameter of the transducer 1. In other words, the size of the magnetic circuit 2 is maximum with respect of the overall diameter of the transducer 1, which increases its power handling together with the value of the magnetic field, and hence the sensitivity of the transducer 1.

The core 5 has an overall diameter smaller than the inner diameter of the side wall 8 of the yoke 4, so that between the core 5 and the side wall 8 is defined a secondary air gap 15 in which is concentrated most part of the magnetic field generated by the magnet 3.

In the air gap 15, the edges of the core 5 and of the yoke 4 may be chamfered, or preferably (and as depicted on FIG. 1), rounded so as to avoid harmful burrs.

The transducer 1 also comprises a moving part 16 including a dome shaped diaphragm 17 and a movable coil 18 fixed to the diaphragm 17.

The diaphragm 17 is made of a light and rigid material, a thermoplastic polymer or an aluminum-based alloy, magnesium or titanium. The diaphragm 17 is such positioned as to cover the magnetic circuit 2 on the side of the core 5, and such that its axis of rotational symmetry be merged with the axis A2.

Hence, the apex of the diaphragm 17, located on the axis A2, may be regarded as the acoustical center C2 thereof, i.e. the equivalent punctual source from which the transducer 1 acoustically radiates.

The diaphragm 17 has a circular peripheral edge 19 which is slightly turned up, in order to facilitate the fixing of the movable coil 18.

The movable coil 18 comprises a conductive metal (e.g. copper or aluminum) wire solenoid, having a preferred width of 0.3 mm, spiral winded to form a cylinder, an upper end of which is glued to the turned-up peripheral edge 19 of the diaphragm 17. Here, the coil 18 has no support (but could have one).

The movable coil 18 dives in the air gap 15. The inner diameter of the moving coil 18 is slightly higher than the outer diameter of the core 5, so that the inner operation clearance between the moving coil 18 and the core 5 is small with respect of the width of the air gap 15. However, in an alternate embodiment, the operation clearance may be dimensioned in a conventional way.

In a preferred embodiment, the edge at least of the core 5 (and possibly the inner surface of the lateral wall 8), is coated with a low friction polymer layer, such as polytetrafluoroethylene (PTFE, also known as TEFLON™), having a thickness of about or smaller than a hundredth of a millimeter, and preferably of several tens of pm (such as about 20 μm).

In consequence, despite the small clearance between the core 5 and the moving coil 18, on the one hand, the positioning of the moving coil 18 within the air gap 15 is somewhat easy and, on the other hand, in operation the axial movement of the moving coil 18 is not impeded by the proximity of the core 5, even in the event both elements would accidentally and temporarily contact.

Practically, the moving coil 18 and the air gap 15 are preferably such dimension that:

- clearance between the moving coil 18 and the core 5 including its coating be smaller than a tenth of a millimeter, and for example comprised between 0.05 and 0.1 mm. In a preferred embodiment, the inner clearance is of 0.08 mm (it might however be classically dimensioned);
- the outer clearance between the moving coil 18 and the side wall 8 of the yoke 4 is smaller than 0.2 mm, and for example comprised between 0.1 and 0.2 mm. In one embodiment, the outer clearance is of 0.17 mm.

Accordingly, the maximal width of the air gap 15, for a moving coil 18 having a width of 0.3 mm, is of 0.6 mm (with an inner clearance of 0.1 mm and an outer clearance of 0.2 mm). In such a configuration, the occupation rate of the moving coil 18 within the air gap 15 which is equal to the ratio of the sections of the moving coil 18 and air gap 15, is of about 50% (considered as a minimum). In the preferred configuration, for an air gap width of 0.55 mm, an inner clearance of 0.08 mm and an outer clearance of 0.17 mm, the occupation rate of the moving coil 18 in the air gap 15 is of about 55%.

Those values, which are equal to or greater than 50%, are to be compared to occupation rates of known transducers, generally smaller than about 35%.

As a result, the density of magnetic flow within the air gap 15 is increased, and the sensitivity of the transducer 1 is subsequently increased, whereby the sensitivity is proportional to the square of the augmentation of the density of magnetic flow within the air gap 15.

It is advantageous to fill the air gap 15 with a mineral oil loaded with magnetic particles, such as of the type sold by FERROTEC under trade name Ferrofluid™. Such a filling has the following advantages:

- it contributes to the centering of the movable coil 18 within the air gap 15;
- it functions as a dynamic lubricant, and therefore contributes to the silent operation of the transducer 1;
- its thermal conductivity, which is far higher than the thermal conductivity of air, contributes to the evacuation, toward the magnetic circuit 2 (and more specifically toward the yoke 4), of the heat produced by Joule effect within the movable coil 18.

The transducer 1 further comprises a support 20 fixed to the magnetic circuit 2 and to which the moving part 16 is suspended. The support 20, which is made of a diamagnetic and electrically insulating material, for example a thermoplastic material such as polyamide or polyoxymethylen (charged with glass or not), has a general shape of rotational symmetry around an axis merged with the axis A2, and has a T-shaped section.

The one-piece support 20 forms an endoskeleton for the transducer 3 and includes an annular plate 21 contacting the front face 14 of the core 5, and a cylindrical rod 22 which protrudes backwards from the center of the plate 21, and which is located in a complementary cylindrical recess 23 formed within the magnetic circuit and formed by a succession of coaxial drillings made in the yoke 4, the magnet 3 and the core 5.

As depicted on FIG. 1, the endoskeleton 20 is rigidly fixed to the magnetic circuit 2 by means of a nut 24 screwed onto a threaded section of the rod 22 and tightened against the yoke 4, within a counterbore 25 formed in the back face 10, at its center. Thereby, the plate 21 is tightly urged against the front face 14 of the core 5, without rotational possibility. This fixing may be completed by a glue film between the plate 21 and the core 5.

Given its frontal situation with respect of the magnetic circuit 2, the plate 21 extends within the lenticular inner volume limited by the diaphragm 17. The plate 21 comprises a peripheral annular rim 26 and a central disc 27 to which the rod 22 is connected. The disc 27 may be provided with holes 28 a function of which is to maximize the volume of air underneath the diaphragm 17, in order to decrease the resonance frequency of the moving part 16.

The rim 26 has substantially the shape of a pulley and comprises a peripheral annular groove 29 which radially opens outwardly, facing an annular peripheral portion 30 of the inner surface of the diaphragm 17, in the vicinity of the edge 19.

The groove 29 splits the rim 26 in two facing flanges forming side walls of the groove 29, namely a back flange 31, contacting the front face 14 of the core 5, and a front flange 32. The flanges 31, 32 are connected through a cylindrical web 33 forming the bottom of the groove 29.

The moving part 16 is mounted onto the endoskeleton 20 by means of an inner suspension 34 which connects the diaphragm 17 and the plate 21. This suspension 34 has the shape of a ring and is made of a light, elastic, acoustically non emissive material (the material may be porous). This material is preferably resistant to heat within the transducer, and its elasticity is chosen so that the resonance frequency of the moving part 16 be smaller than the lowest frequency reproduced by the transducer 1 (i.e. 500 Hz to 2 kHz). Polymer foams (such as polyester or melamine foams) are well adapted, due to their high porosity.

In an alternate embodiment, the suspension 34 is made in a fabric of natural fibers (such as cotton) or synthetic fibers (such as polyester, polyacrylic, Nylon™, and more specifically aramides such as Kevlar™), or in a mixture of natural and synthetic fibers (such as cotton-polyester), wherein the fibers are impregnated with a thermosetting or thermoplastic resin and are thermoformed to provide spider type corrugations.

In the absence of acoustical emissivity of the suspension 34, only the dome diaphragm 17 emits an acoustical radiation, whereby fundamental modes, resonances, and more generally parasite acoustical radiation of suspension 34, which would interfere with radiation of the diaphragm 17 and would therefore decrease the performance of the transducer 1, are avoided.

The suspension 34 has a section in a substantially polygonal shape and comprises a straight inner edge 35, i.e. with rotational symmetry around the secondary axis A2, and a peripheral outer edge 36 of substantially frusto-conical shape.

Through its outer edge 36, the suspension 34 is glued to the peripheral portion 30 of the inner surface of the diaphragm 17. Alternately, in case the movable coil 18 includes a cylindrical support fixed to the diaphragm 17 and onto which the solenoid is mounted, the suspension 34 may be fixed, through its peripheral edge (which would then be cylindrical), onto the inner surface of such support.

As depicted in FIG. 1, the thickness of suspension 34 (measured along the axis A2), although smaller than its free length (measured radially between the flanges 31, 32 and the inner surface 30 of the diaphragm 17), is not immaterial but of the same order of size than this length. More precisely, the ratio between the free length and the thickness of the suspension 34 is preferably smaller than 5 (and here smaller than 3). Minimizing the free length of the suspension 34 allows for stabilizing the moving part 16 and prevents tilting thereof (anti-pitch effect).

On the side of its inner edge 35, the suspension 34 is located within the groove 29 with a slight compression between the flanges 31, 32 in order to avoid parasite noises, but without being fixed thereto. In addition, the inner diameter of the suspension is higher than the inner diameter of the groove 29 (i.e. to the outer diameter of the web 33), such that an annular space 37 is formed between the suspension 34 and the web 33.

Accordingly, the suspension 34 is floating with respect of the rim 26 of the plate 21, with a possible radial clearance, whereby the suspension 34 may slip with respect of the flanges 31, 32. In order to contribute to this slipping, a layer of pasty lubricant (such as grease) may be applied onto the flanges 31, 32. The radial clearance defined by the annular space 37 between the suspension 34 and the web 33 (i.e. the bottom of the groove 29) is preferably less than 1 mm. In a preferred embodiment, the clearance is of about 0.5 mm. In the drawings, this clearance is exaggerated for the sake of clarity.

In addition, it is preferable that the part of suspension 34 located within the groove 29 have a width (measured radially) higher or equal to its thickness, in order to ensure good mechanical link of the planar contact type and minimize any harmful tilting of the suspension 34 with respect of the plate 21.

The suspension 34 thereby extends inside the diaphragm 17. The suppression of an external peripheral suspension allows for avoiding acoustical interferences which exist in known transducers, between the radiation of the diaphragm and the radiation of its suspension.

In addition, as the suspension 34 exerts no radial constraint on the diaphragm 17, it does not provide any centering function of the diaphragm with respect of the secondary magnetic circuit 2, thereby improving the simplicity of assembly of the secondary transducer 3, or of replacement of the diaphragm 17 in case of failure.

The centering of the diaphragm 17 is achieved at the level of the movable coil 18, which is adjusted with a small clearance onto the core 5 and automatically centers with respect thereof as soon as the movable coil 18, dived into the magnetic field of the air gap 15, is displaced by a modulation electric current.

However, the suspension 34 provides a return function to the moving part 16 toward an intermediate rest position, in which the moving part 16 stands in the absence of any axial constraint on the movable coil 18 (i.e., practically, in the absence of an electrical current therethrough). It is in this intermediate position that the transducer 1 is illustrated in the drawings.

The suspension 34 also provides a function of maintaining the trim of the diaphragm 17, i.e. of maintaining the peripheral edge 19 of the diaphragm 17 in a plane perpendicular to the axis A2, in order to avoid tilting (or pitch) of the diaphragm 17 which would affect its good operation.

The electric current is provided to the movable coil 18 by two electrical circuits 38 which link the ends of the movable coil 18 to two feeding electrical terminals (not illustrated).

As depicted in FIG. 1, each electrical circuit 38 comprises:

- an electrical conductor 39 of great diameter, including a copper wire insulated with a plastic jacket, extending through the magnetic circuit 2 and located within a slot formed longitudinally within the rod 2 of the endoskeleton 20, and a stripped front end 40 of which opens in the inner volume of the diaphragm 17 and protrudes from the magnetic circuit 2 in one hole 28 of the disc 27;
- an electrical connection element under the form of a metal eye 41 (which may be made of copper or brass) crimped within the hole 28 and to which the stripped end 40 of the conductor 39 is electrically linked (for example by means of a welding point, not illustrated);
- a conductor 42 of small diameter, under the form of a resilient metallic braid suitably formed, which extends within the internal volume of the diaphragm 17 and extending over the rim 26 and the suspension 34, an inner end 43 of which is electrically connected to the eye 41 (for example by means of a welding point, not illustrated), and an opposite outer end of which is electrically connected to an end of the movable coil 18.

Only one conductor 42 of small diameter is visible on FIG. 1. The second one, which is diametrically opposite to the latter, is located in front of the section plane of the figure.

Due to their arcuate form (U-shape of the conductors 42, and to their great resilience, the conductors may deform easily and follow the movements of the diaphragm 17 which accompany the vibrations of the movable coil 18, without adding any radial or axial constraint which might compromise the positioning of the moving part 16.

The transducer 1 comprises an acoustical waveguide 44, fixed to the magnetic circuit 2.

The waveguide 44 is one piece and is made of a material having a high thermal conductivity, higher than 50 $W.m^{-1}.K^{-1}$, such as in aluminum (or an aluminum alloy).

The waveguide 44 has a rotational symmetry, is fixed to the yoke 4 and comprises a substantially cylindrical outer side wall 45 which extends flush with the side wall 8 of the yoke 4. The waveguide is preferably screwed, by means of at least three screws. In order to maximize thermal contact between both pieces, it is advantageous to complete the screwing by applying a heat conducting paste.

As depicted on FIG. 1 and FIG. 2, the waveguide 44 has, on a back peripheral edge, a skirt 46 which adjusts in a shoulder 47 made in the yoke 4, of complementary shape, whereby a precise centering of the waveguide 44 with respect of the yoke 4, and more generally with respect of the magnetic circuit 2 and the diaphragm 17, is provided. In addition, thermal conduction between both pieces 4, 44 is enhanced.

The waveguide 44 has a back face 48 shaped like a substantially spherical cap, which extends in a concentric way with respect of the diaphragm 17, facing and in the vicinity of an outer face thereof, which the back face 48 partly covers.

In an preferred embodiment depicted in FIG. 1-4, the back face 48 is provided with openings and comprises a continuous peripheral portion 49 which extends in the vicinity of the back edge of the waveguide 44, and a discontinuous central portion 50 carried by a series of wings 51 which radially protrude inwardly (i.e. towards the axis A2 of the transducer 1) from the side wall 45. The back face 48 is limited inwardly—i.e. on the diaphragm side—by a petaloid shaped edge 52.

As depicted on FIG. 1, the wings 51 do not meet at the axis A2 but are interrupted at an inner end located at a distance from axis A2. At its apex, each wing 51 has a curved edge 53.

The side wall 45 of the waveguide 44 is limited inwardly by a discontinuous frusto-conical front face 54 divided into a plurality of angular sectors 55 which extend between the wings 51. This front face 54 forms a horn initial section extending from the inside to the outside and from a back edge, formed by the petaloid edge 52 which forms a throat of the horn initial section 54 up to a front edge 56 which forms a mouth of the horn initial section 54. The angular sectors 55 of the horn initial section 54 are portions of a cone with rotational symmetry the axis of which is merged with the axis A2, and the generatrix of which is curved (for example following a circular, exponential or hyperbolic law). The horn initial section 54 ensures a continuous acoustical impedance adjustment between the air environment limited by the throat 52 and the air environment limited by the mouth 56.

In an embodiment, the tangent to the horn initial section 54 on the mouth 56 forms, together with a plane perpendicular to the axis A2 of the transducer 1, an angle comprised between 30° and 70°. In the depicted example, this angle is of about 50°.

Each wing 51, one function of which is to increase the surface of the waveguide 44 to contribute to dissipation and convection of heat produced by the movable coil 18, has two side flanges 57 which outwardly connect to the angular sectors 55 of the horn initial section 54 through fillets 58.

The side flanges 57 contribute to guiding the wave generated by the diaphragm 17.

Figure 5:
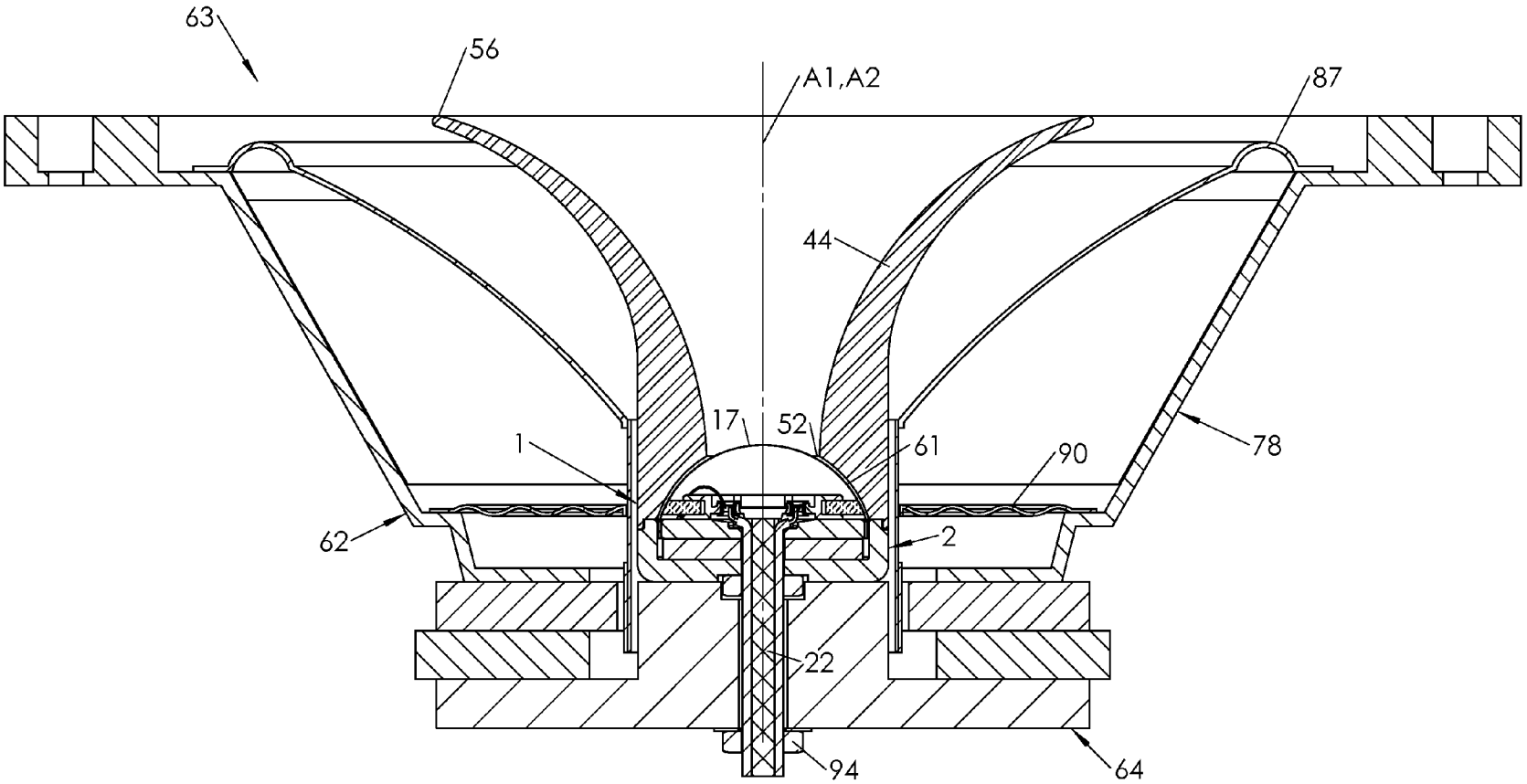
FIG. 5 is a view similar to FIG. 4, showing a coaxial loudspeaker system comprising a low range transducer, and a high range transducer in an alternate embodiment.

In an alternate embodiment depicted on FIG. 5, the waveguide 44 does not form a horn initial section but a whole horn (which may be of rotational symmetry around the axis A2), the throat 52 of which is of circular shape and the mouth 56 of which has a diameter far greater than the diameter of the throat 52.

The waveguide 44 limits on the diaphragm 17 two distinct and complementary zones, namely:

- an uncovered outer zone 59, of petaloid shape, outwardly limited by the throat 52,
- a covered outer zone 60, the shape of which is complementary to the covered zone 59, inwardly limited by the throat 52.

The back face 48 of the waveguide 44 and the corresponding covered outer zone 60 of the diaphragm 17 together define an air volume 61 called compression chamber, in which the acoustical radiation of the vibrating diaphragm 17 driven by the coil 18 moving in the air gap 15 is not free, but compressed. The uncovered inner zone 49 directly connects to the facing throat 52, which concentrates acoustical radiation of the whole diaphragm 17.

The compression rate of the transducer 1 is defined by the ratio of the emitting surface, corresponding to the planar surface limited by the overall diameter of the diaphragm 17 (measured on the edge 19) and the surface limited by the projection, in a plane perpendicular to the axis A2, of the throat 52. This compression rate is preferably higher than 1.2:1, and for example equal or greater than 1.4:1. Higher compression rates, for example up to 4:1, are possible.

The hereabove transducer 1 may be used in an individual matter or coupled to a low range transducer 62 for forming a several-way loudspeaker system 63 designed to cover a large acoustical spectrum, ideally the whole audio bandwidth.

Practically, the low range transducer 62 may be designed to reproduce the low range and/or the mid range, and possibly part of the high range. To this end its diameter shall preferably be comprised between 10 cm and 38 cm. Although the main object of the present invention does not include the definition of parameters regarding the spectrum covered by the different transducers of the system 63, it shall be however noted that the spectrum of the low range transducer 62 may cover the low range, i.e. the range of 20 Hz-200 Hz, or the mid-range, i.e. the rage of 200 Hz-200 Hz, or even at least part of the mid-range and low range (and for example the whole low range and mid-range) and possibly part of the high range. As an example, the low range transducer 62 may be designed to cover a bandwidth of 20 Hz-1 kHz, or 20 Hz-2 kHz, or even 20 Hz-4 kHz.

The high range transducer 1 is preferably designed so that its pass band is at least complementary to the low range transducer 62 in high range. One may therefore ensure that the pass band of the high range transducer 1 covers at least part of the mid-range and the whole high range, up to 20 kHz.

It is preferable that the linear responses of the transducer 1, 62 at least partly cross, and that the sensitivity level of the high range transducer 1 be at least equal to that of the low range transducer 62, in order to avoid a decrease of the global response of the system 63 at certain frequencies corresponding to the higher part of the spectrum of the low range transducer 62 and to the lower part of the spectrum of the high range transducer 1.

The low range transducer 62 comprises a magnetic circuit 64 which includes an annular magnet 65, sandwiched between two soft steel pole pieces which form field plates, i.e. a back pole piece 66 and a front pole piece 67, glued on opposite face of the magnet 65.

The magnet 65 and the pole pieces 66, 67 have a rotational symmetry around a common axis A1, forming the general axis of the low range transducer 62.

In the depicted embodiment, the back pole piece 66 is of one piece and comprises an annular bottom 68 fixed to a back face 69 of the magnet 65, and a central cylindrical core 70, which has a front face 71 opposite the bottom 68 and is provided with a central bore 72 opening on both sides of the pole piece 66.

The pole piece or front plate 67 has the form of an annular washer and has a back face 73, by means of which it is fixed to a front face 74 of the magnet 65, and an opposite front face 75 which extends in the same plane as the front face 71 of the core 70.

The front plate 67 has at its center a bore 76 the inner diameter of which is greater than the external diameter of the core 70, so that between the bore 76 and the core which is located therein is defined an air-gap 77 in which part of the magnetic field generated by the magnet 65 is present.

The low range transducer 62 includes a chassis 78 called basket, which includes a base 79 through which the basket 78 is fixed to the magnetic circuit 64-and more precisely to the front face 75 of the front plate 67-, a crown 80 through which the transducer 62 is fixed to a holding structure, and a plurality of branches 81 linking the base 79 and the crown 80.

The low range transducer 62 additionally comprises a movable part 82 including a diaphragm 83 and a movable coil 84 comprising a solenoid 85 coiled around a cylindrical support 86 fixed to the diaphragm 83.

The diaphragm 83 is made of a light rigid material such as impregnated cellulose pulp, and has a conical or frusto-conical shape with rotational symmetry around the axis A1, with a curved generatrix (such as a circular, exponential or hyperbolic law).

The diaphragm 83 is fixed on the surround of the crown 80 by means of a peripheral suspension 87 (also called rim) which may be made of an add-on tore piece glued to the diaphragm 83. The suspension 87 may be elastomeric (such as of natural or artificial rubber), polymeric (honeycombed or not) or in an impregnated and coated fabric or nonwoven.

In its center, the diaphragm 83 defines an opening 88 on the inner edge of which the support 86 is glued by a front end thereof. The geometrical center of the opening 88 is considered, in first approximation, as the acoustical center C1 of the low range transducer 62, i.e. the equivalent punctual source from which the acoustical radiation of the low range transducer 62 is generated.

A hemispheric dust cap 89, made of an acoustically non emitting material, may be affixed to the diaphragm 83 in the vicinity of the opening 88 to protect the latter from dust.

The solenoid 85, made of a conductive metal wire (such as copper or aluminum), is rolled on the support 86, at a back end thereof located within the main air gap 77. Depending upon the diameter of the low range transducer 62, the diameter of the solenoid 85 may be comprised between 25 mm and over 100 mm.

The centering, the elastic return force and the axial guiding of the movable piece 82 are achieved by the peripheral suspension 87 and by a central suspension 90, also called spider, of generally annular shape, with concentric corrugations, and having a peripheral edge 91 by which the spider 90 is glued to an edge 92 of the basket 78 in the vicinity of the base 79, and an inner edge 93 buy which the spider 90 is glued to the cylindrical support 86.

The solenoid 85 is provided with electrical signal in a classical way by means of two electrical conductors (not illustrated) connecting each end of the solenoid 85 to an electrical terminal of the transducer 62, where the link is made to a power amplifier.

Figure 4:
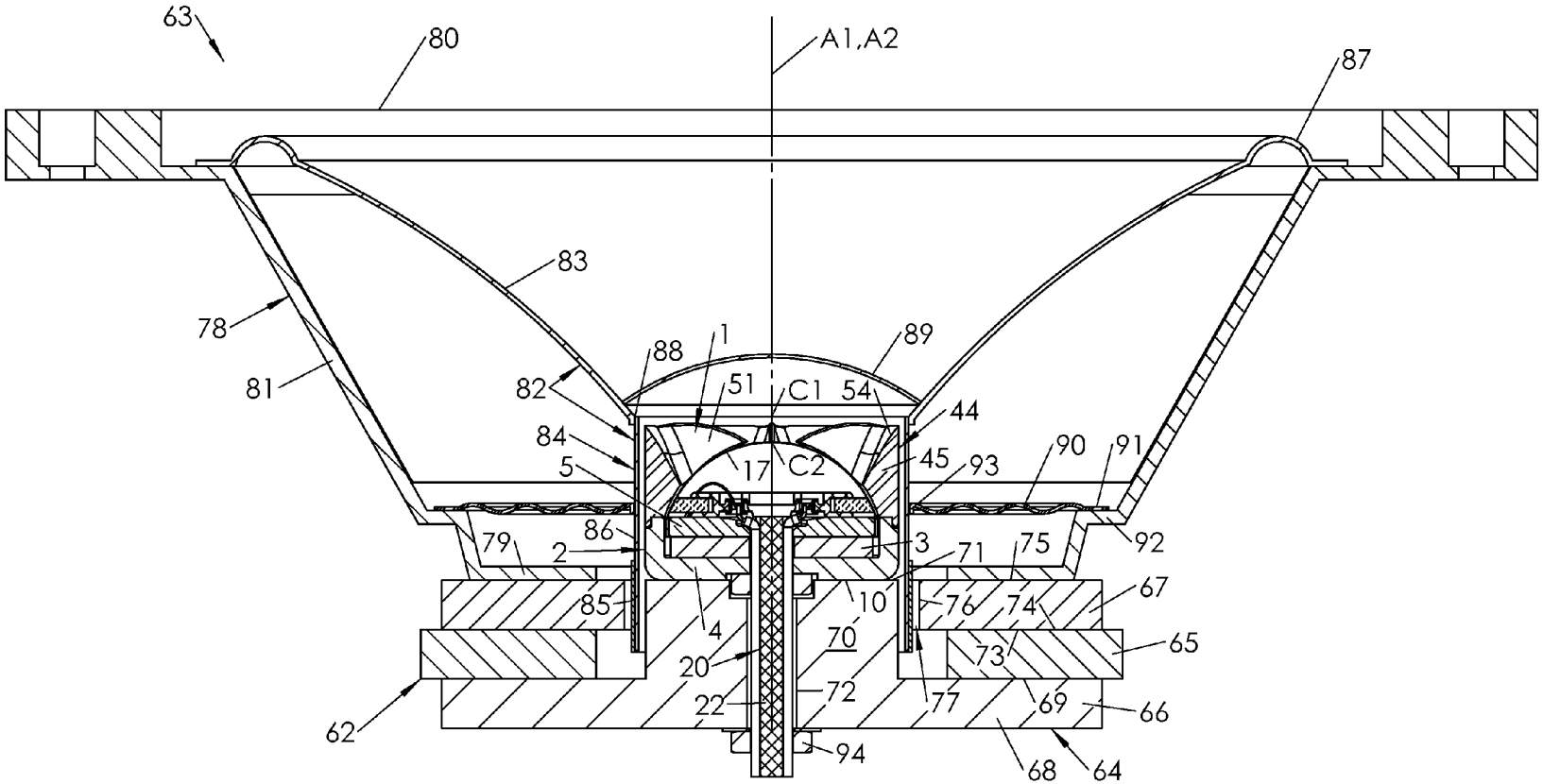
FIG. 4 is a sectional view showing a coaxial loudspeaker system comprising a low range transducer, and the high range transducer of FIG. 1 mounted therein in a coaxial and frontal position.

As depicted on FIG. 4, the high range transducer 1 is housed within the low range transducer 62 within a central frontal room (on the front side of the magnetic circuit 64) limited backwards by the front face 71 of the core 70, and sidewise by the inner wall of the support 86.

As depicted on FIG. 4 and FIG. 5, the high range transducer 1 may be mounted within the low range transducer 62 both:

- In a coaxial way, i.e. the axis A1 of the low range transducer 62 and the axis A2 of the high range transducer 1 are merged,
- In a frontal way, i.e. the transducer 1 is positioned in the front of the magnetic circuit 64 (i.e. on the side of the magnetic circuit 64 where the diaphragm 83 is located).

This so-called "frontal" assembly, which is opposite to the rear assembly in which the transducer is mounted on the back face of the yoke (cf. e.g. U.S. Pat. No. 4,164,631 to Tannoy) is made possible due to the miniaturization of the high range transducer 1, obtained without reducing the emitting surface of the diaphragm 17.

Such a miniaturization results both from the extra-thin and extra-wide form of the magnetic circuit 2 (which has the overall diameter of the transducer 1) and from the manufacturing of the diaphragm 17 which allows for the maximization of its emitting surface.

Compactness of the magnetic circuit 2 (in particular its low thickness) is made possible through the use of a neodymium iron boron magnet 3. However, such compactness would have been vain should the diaphragm 17 have been made in a classical way including a peripheral suspension.

Indeed, in such a configuration the diameter of the effective radiating surface of the diaphragm is smaller than the overall diameter of the diaphragm, whereby only an inner part of the suspension contributes to the acoustical radiation whereas its outer part, interconnected to a fixed part of the transducer, is passive. In such a known configuration, the diameter of the frontal radiating surface is insufficient and does not allow the coaxial frontal assembly, since it is not possible to manufacture a short horn initial section capable of being aligned with the diaphragm of the low range transducer in the available room.

A known diaphragm has an effective radiating surface smaller than its physical surface, and often insufficient to allow a for a good reproduction of the lower part of high range frequencies or the higher part of mid range frequencies and therefore does not allow the high range transducer to ensure a proper junction with the upper part of the spectrum reproduced by the low range transducer.

On the contrary, the diaphragm 17 of the high range transducer 1 with its inner suspension 34 has a 100% radiating surface, i.e. the diameter of the effective radiating surface is equal to the overall diameter of the diaphragm 17. The gain of radiating surface is higher than about ⅙—i.e. more than 16%—with respect of the known diaphragms.

Such a gain allows for decreasing the lower limit of the frequency bandwidth reproduced by the high range transducer 1, and hence for enhancing the homogeneity of the system 63. The induced increase of the diameter of the moving coil 18 allows for an increase of the sensitivity and power handling of the transducer of a factor proportional to the gain of radiating surface (i.e. proportional to the square of the diaphragm diameter).

Practically, the transducer 1 is fixed to the main magnetic circuit 64 on the front side thereof and is received, as already stated, in a space limited backwards by the front face 71 of the core 70, and sidewise by the inner wall of the cylindrical support 86; the yoke 4 of the magnetic circuit 2 is urged directly, or through a spacer, against the front face 71 of the core 70. To this end, the transducer 1 has an overall diameter lower than the inner diameter of the cylindrical support 86. However, it is preferable to minimize the clearance between the transducer 1 and the support 86, in order to reduce the harmful acoustical effect produced by the annular cavity formed between them. This clearance should however be sufficient to prevent friction of the support 86 onto the transducer 1. A low clearance, of several tenths of millimeters (comprised e.g. between 0.2 mm and 0.6 mm) is a good compromise (on FIG. 4 and FIG. 5 such clearance is exaggerated for the sake of clarity).

The rod 22 of endoskeleton 20 is received within the bore 72 of the core 70, and the transducer 1 is rigidly fixed to the magnetic circuit 2 of the low range transducer 62 by means of a nut 94 screwed onto a threaded portion of the rod 22 and tightened against the yoke 66, possibly with a washer therebetween, as depicted on FIG. 4 and FIG. 5.

In addition to the coaxial frontal positioning of the transducer 1 with respect of the low range transducer 62, their respective geometries, the thickness of the magnetic circuits 2, 64 and the curvature (and hence the depth) of the diaphragm 83, are preferably adapted to permit at least an approximate coincidence of the acoustic centers C1, C2 of the transducers 1, 62, such that the time offset between the acoustical radiation of the transducer 1, 62 be unperceivable (this situation is called time alignment of the transducers 1, 62). The system 63 may then be regarded as perfectly coherent despite duality of the sound sources.

In addition, in the embodiment depicted on FIG. 4, the axial positioning of the high range transducer 1 with respect of the low range transducer 62, together with the geometry of the waveguide 44, are such that the diaphragm 83 is aligned with the horn initial section 54. In other words, the tangent to the horn initial section 54 on the mouth 56 merges with the tangent to the diaphragm 83 at its central opening 88. In such a configuration, the waveguide 44 and the diaphragm of the low range transducer together form a complete horn for the high range transducer 1, permitting both transducers 1, 62 to have homogeneous directivities.

In the alternate embodiment of FIG. 5, the waveguide 44 forming a whole horn is independent from the diaphragm 83 of the low range transducer 62. In such configuration, the directivities of the transducers 1, 62 are distinct and may be optimized separately, which is advantageous in some applications, such as stage monitor speakers.

Figure 6:
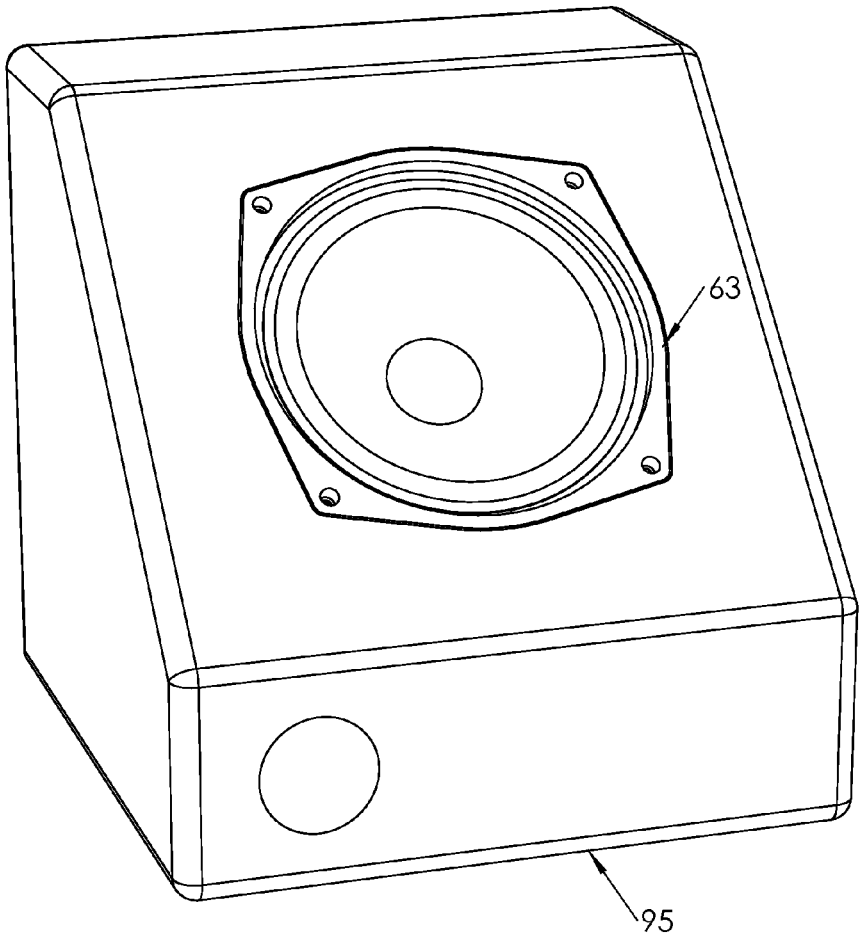
FIG. 6 is a perspective view showing a loudspeaker enclosure including a coaxial loudspeaker system as illustrated on FIG. 4.

The system 63 may be mounted on any type of loudspeaker enclosure, such a stage monitor loudspeaker 95, with an inclined front face, as in the depicted example of FIG. 6.

The invention claimed is:

1. Electro-dynamic transducer including:

a main magnetic circuit defining an air gap, a moving part comprising a dome shaped diaphragm and a movable coil fixed thereto and diving into the air gap;

a support from which the moving part is suspended;

a suspension linking the moving part and the support;

wherein the suspension is floating with respect to the support, allowing a radial degree of freedom; and wherein an end face of one end of the suspension extends in a peripheral groove of the support and is unattached.

2. Transducer according to claim 1, wherein the suspension is in the form of a ring an inner edge of which is cast into the grove.

3. Transducer according to claim 2, wherein a clearance of more than 0.1 mm is provided between the suspension and a bottom of the groove.

4. Transducer according to claim 2, wherein the support comprises a plate in which the groove is formed, and a rod fixed to the plate and through which the support is fixed to the magnetic circuit.

5. Transducer according to claim 2, wherein the groove is limited by two facing flanges and the suspension is slightly constrained between the flanges.

6. Transducer according to claim 2, wherein the ratio between a free length and a thickness of the suspension is smaller than 5.

7. Transducer according to claim 1, wherein the suspension is made of a polymer reticulated foam.

8. The transducer of claim 7, wherein the polymer is a melamine foam.

9. Transducer according to claim 1, wherein at least one wall of the air gap is coated with a low friction material.

10. The transducer of claim 9, wherein the low friction material is PTFE.

11. Transducer according to claim 1, wherein the air gap and the moving coil are such dimensioned that the occupation rate of the moving coil within the air gap is equal or greater than 50%.

12. Transducer according to claim 1, wherein the magnetic circuit comprises a pole piece around which the moving coil is positioned, and a clearance of less than a tenth of a millimeter is provided between them.

13. Transducer according to claim 1, wherein a lubricant is provided between the suspension and the support.

14. Coaxial two-way or more loudspeaker system comprising a low range electro-dynamic transducer for the reproduction of low range and/or mid range frequencies, and an electro-dynamic transducer according to claim 1, for the reproduction of high range frequencies.

15. System according to claim 14, wherein the high range transducer is mounted in a coaxial and frontal position with respect to the low range transducer.

16. Loudspeaker enclosure including a coaxial loudspeaker system according to claim 14.

17. Loudspeaker enclosure including a transducer according to claim 1.

18. An electro-dynamic transducer comprising:

a main magnetic circuit defining an air gap, a moving part, comprising a dome shaped diaphragm and a movable coil fixed to the diaphragm, the moving part configured to move within the air gap;

a support from which the moving part is suspended;

a suspension attaching the moving part to the support;

wherein the suspension is configured such that the suspension has a radial degree of freedom with respect to the support so that the suspension can move radially relative to the support; and wherein an end face of one end of the suspension extends in a peripheral groove of the support and is unattached.

19. The electro-dynamic transducer of claim 18, wherein a gap is defined between a bottom of the peripheral groove and the one end of the suspension to allow the suspension to move within the peripheral groove in a radial direction.

* * * * *